US007670179B2

(12) United States Patent
Müller

(10) Patent No.: US 7,670,179 B2
(45) Date of Patent: Mar. 2, 2010

(54) CONNECTING ELEMENT FOR SHIELDED USOC RJ TELECOMMUNICATION AND/OR DATA CABLES HAVING METAL HOUSING

(75) Inventor: Hartmut Müller, Bräunlingen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 11/384,487

(22) Filed: Mar. 21, 2006

(65) Prior Publication Data

US 2006/0216997 A1 Sep. 28, 2006

(30) Foreign Application Priority Data

Mar. 23, 2005 (DE) ..... 20 2005 004 929 U

(51) Int. Cl.
*H01R 13/648* (2006.01)

(52) U.S. Cl. ..... 439/607.01; 439/607.53; 439/607.17; 439/638

(58) Field of Classification Search ..... 439/607, 439/609, 638, 607.01, 607.53, 607.17
See application file for complete search history.

(56) References Cited

U.S. PATENT DOCUMENTS

| | | | | |
|---|---|---|---|---|
| 5,228,871 | A * | 7/1993 | Goodman | 439/607 |
| 5,509,823 | A * | 4/1996 | Harting et al. | 439/607 |
| 5,704,813 | A * | 1/1998 | Weeks et al. | 439/694 |
| 5,934,940 | A * | 8/1999 | Maranto et al. | 439/607 |
| 2001/0004567 | A1 * | 6/2001 | Chen et al. | 439/607 |

FOREIGN PATENT DOCUMENTS

DE 100 57 869 C1 8/2002

* cited by examiner

*Primary Examiner*—Tho D Ta
(74) *Attorney, Agent, or Firm*—The Nath Law Group

(57) ABSTRACT

A connecting element (1) for shielded data and/or telecommunications cables (2, 3), with a metal housing (10) and with at least one connector jack (15, 16), where contact means (20, 21) are provided for contacting the metal housing (10) with a plug housing (6, 7), particularly with the plug housing (6, 7) of an RJ-45 plug (4, 5), and where at least one spring tab (20, 21) forming a single piece with the metal housing (10), or with a part (8, 9) of the metal housing, is provided as the contacting means (20, 21).

17 Claims, 2 Drawing Sheets

Figure 3:
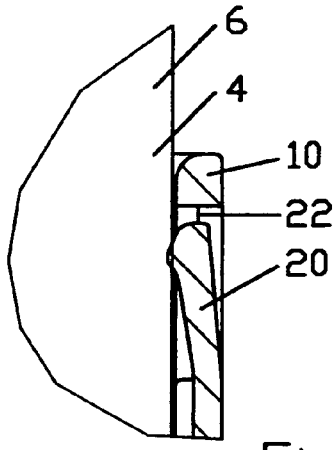

CONNECTING ELEMENT FOR SHIELDED USOC RJ TELECOMMUNICATION AND/OR DATA CABLES HAVING METAL HOUSING

The invention relates to a connecting element for shielded telecommunication and/or data cables, with a metal housing and at least one jack, where means are provided for contacting the metal housing with a plug housing, particularly the plug housing of an RJ-45 plug.

In data and/or telecommunication networks, shielded cables are usually used in order to prevent the release of high-frequency signals and the interception of high-frequency interference. In the case of the connecting elements for such cables it is therefore necessary to insure that there is also shielding in the area of the connecting element. For this reason, the connecting elements have metal housings which shield the contacts. As a rule, the cables exhibit a plug with a shielded plug housing, such that the cable shielding is continued across the plug housing and across the metal housing of the connecting element to the plug housing of another cable, or directly to the shielding of the other cable. To produce an electrical contact between the metal housing and the plug housing for an RJ-45 plug, it is known from DE 100 57 869 C1 to provide a metal screening sheet inside of the metal housing, such that the screening sheet contacts the plug housing of a connected cable over contact bridges. An electrically conductive connection is produced across the screening sheet, from the plug housing to the shielding of another connected cable, as well as to the metal housing of the connecting element.

The invention is based on the problem of specifying a connecting element which can be produced more economically and which can be mounted with greater simplicity.

This problem is solved by the features of claim 1.

Advantageous elaborations of the invention are indicated in the secondary claims.

The invention is based on the idea of providing at least one spring tab as a contacting means between the metal housing and the plug housing, and of designing the spring tab so that it forms a single piece with the metal housing, or with a portion of the metal housing. In this way it is possible to eliminate a separate screening sheet for contacting the plug housing to the metal housing of the connecting element. Thus there is a direct contact between the metal housing of the connecting element and the plug housing, as provided by the spring tab forming a single piece with the metal housing. Another advantage conferred by the invention in the direct contacting of the plug housing by the metal housing of the connecting element rests in the fact that the number of contact resistances is reduced. At the same, the elimination of one part considerably reduces the manufacturing and assembly costs.

An elaboration of the invention provides that the connecting element exhibits several connector jacks and that at least one spring tab that is designed to form a single piece with the metal housing is assigned to each connector jack in order to contact the plug housing. The shielded plug housing is directly contacted by the spring tabs forming a single piece with the metal housing, so that the shielding is directly continued from one plug housing to the next across the metal housing.

In order to improve the shielding contact it is advantageously provided that at least two spring tabs, preferably positioned opposite each other, are assigned to each connector jack. To facilitate mounting of the connector it is advantageous if the metal housing is composed of two half-shells, such that a spring tab forming a single piece with the half-shell is assigned to each half-shell in order to directly contact the plug housing.

The shielding effect of the connecting element is optimal when the housing consists of a metal die-casting, particularly a zinc die-casting.

To minimize the contact resistance between the spring tab of the metal housing and the plug housing it is advantageous if the metal housing is at least partially provided with an electrically conductive coating. In particular, the spring tabs producing the contact should be provided with the coating. Nickel or tin is particularly suited for the coating.

The invention is next described in greater detail on the basis of exemplary embodiments depicted in the drawing.

Figure 1:
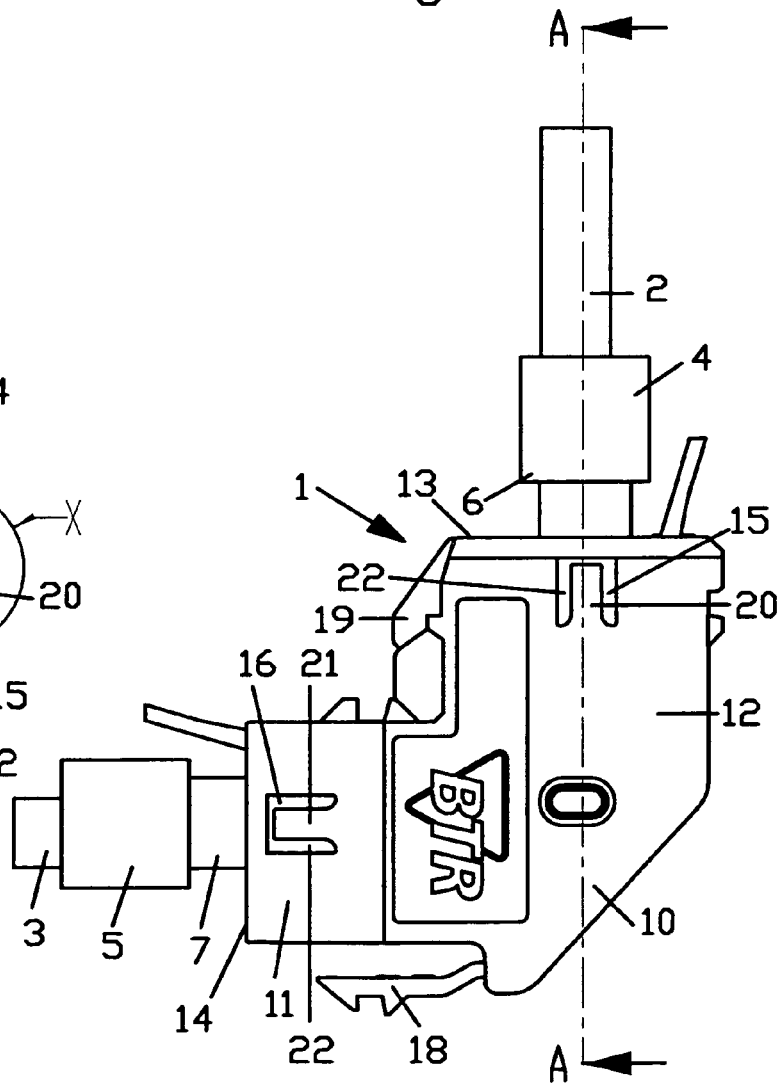

Shown are:

FIG. 1 a side view of a connecting element according to the invention

Figure 2:
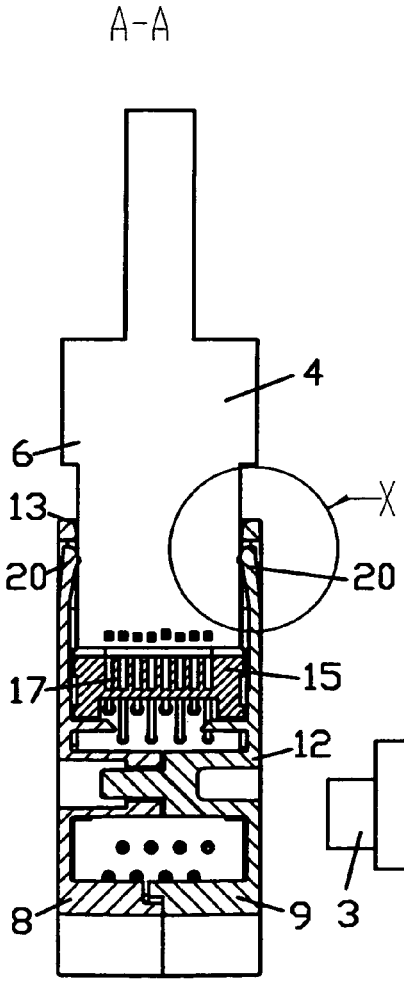

FIG. 2 a section along line A-A in FIG. 1

FIG. 3 an enlarged detail of FIG. 1 (scale: 5:1)

Figure 4:
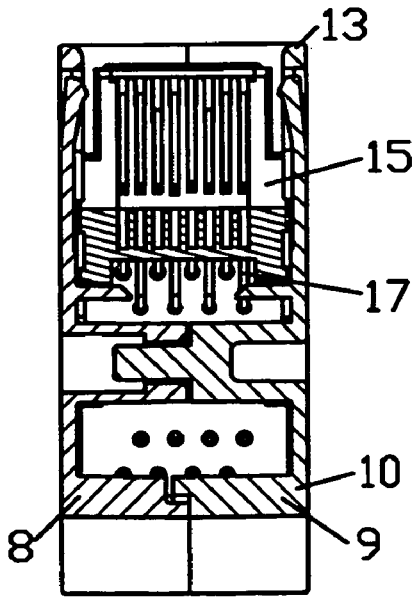

FIG. 4 a section alone line A-A in FIG. 1, without plug

Figure 5:
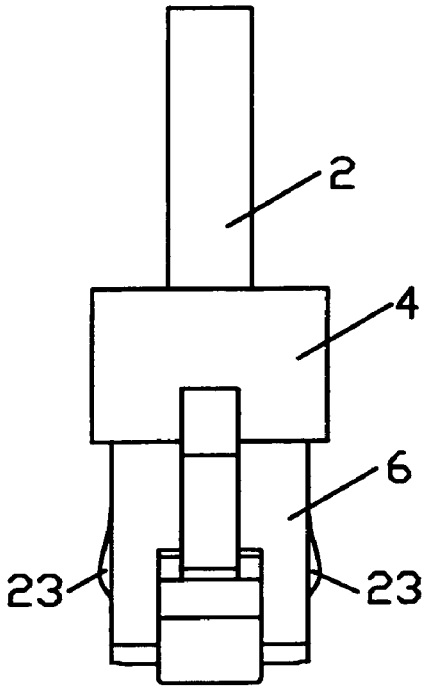

FIG. 5 a cable with an RJ-45 plug

FIG. 1 shows a connecting element 1 for an electrically conductive connection between two shielded cables 2, 3, each with an RJ-45 plug. Each plug, in turn, has a plug housing 6, 7 made of metal. The connecting element 1 exhibits a metal housing 10 of zinc die-casting and consists of two half-shells 8, 9.

The metal housing 10 is L-shaped in design and exhibits two legs 11, 12 positioned at an angle of 90° one to the other. The metal housing 10 is slanted on the outside portion of the connecting area between legs 11, 12.

On each free end 13, 14 of both legs 11, 12 of the metal housing 10 there is a connector jack 15, 16 for receiving the plug housings 6, 7. Provided on the inside of each connector plug 15, 16 is a plurality of contacts 17, such that the contacts 17 of the two connector plugs 15, 16 form an electrical connection with each other on the inside of the metal housing 10.

Each leg 11, 12 is provided with a locking mechanism 18, 19 to permit it to interlock with another component.

Assigned to each of the connector jacks 15, 16 are two facing spring tabs 20, 21 whose purpose is to contact the inserted plug housing 6, 7. The four spring tabs 20, 21 are designed to form a single piece with the metal housing 10, which is to say with the half-shells 8, 9, and a recess 22 is provided around the spring tabs 20, 21 to permit the elastic movement of said spring tabs 20, 21. The spring tabs 20, 21 can easily be bent in the inward direction and against the particular connector jack, in such a way that the two spring tabs lying opposite each other rest against the plug housing 6, 7 in elastic fashion. In this manner the plug housings 6, 7 are directly connected with the metal housing 10 in electrically conductive fashion, with the result that the shielding effect is passed on from one plug housing 6, 7 to the next plug housing 7, 6 across the shielding metal housing 10. A feature the figures do not depict is the shield netting which belongs to each cable 2, 3 and which contacts the given plug housing 6, 7.

In FIG. 5 it can be seen that the plug housings 6, 7 of the RJ-45 plugs 4, 5 exhibit elevated contact areas 23 in order to improve the contact pressure.

LIST OF REFERENCE NUMERALS

1 connecting element
2 data cable
3 data cable
4 plug

5 plug
6 plug housing
7 plug housing
8 half-shell
9 half-shell
10 metal housing
11 leg
12 leg
13 free end
14 free end
15 connector jack
16 connector jack
17 contacts
18 locking mechanism
19 locking mechanism
20 spring tab
21 spring tab
22 recess
23 contact area

The invention claimed is:

1. A connecting element (1) for shielded data and/or telecommunications cables (2, 3), with a metal housing (10) and with at least one connector jack (15, 16), where contact means (20, 21) are provided at a front portion of the metal housing for contacting the metal housing (10) with a plug housing (6, 7), particularly with the plug housing (6, 7) of an RJ-45 plug (4, 5), wherein:

the metal housing (10) consists of a metal die-casting;

at least one spring tab formed as a part of the contact means (20, 21) and forming a single piece with the metal housing (10), or with a part (8, 9) of the metal housing, is provided as the contacting means (20, 21); and the spring tab having a free end facing a front portion of the metal housing, wherein the metal housing (10) is designed in the form of two assembled half-shells (8, 9), such that at least one spring tab (20, 21) is provided for each half-shell (8, 9) and forms a single piece with said half-shell.

2. A connecting element according to claim 1, wherein the connecting element (1) exhibits a plurality of connector jacks (15, 16), and at least one spring tab (20, 21) designed to form a single piece with the metal housing (10) is assigned to each connector jack (15, 16) in order to provide a contact with the plug housing (6, 7).

3. A connecting element according claim 1, wherein at least two spring tabs (20, 21), ideally positioned opposite each other, are assigned to each connector jack (15, 16).

4. A connecting element according to claim 1, wherein the metal housing (10) consists of a zinc die-casting.

5. A connecting element according to claim 1, wherein the metal housing (10) is provided, at least in part, with an electrically conductive coating so that the spring tabs can serve as contacts.

6. A connecting element according to claim 5, wherein nickel and/or tin are provided for the coating.

7. A connecting element for shielded data and/or telecommunications cables, with a metal housing and with at least one connector jack, comprising:

contact means provided at a front portion of the metal housing for contacting the metal housing with a plug housing, particularly with the plug housing of an RJ-45 plug;

the metal housing consists of a metal die-casting the contact means formed as part of the metal die casting; and at least one spring tab formed as a part of the contact means and forming a single piece with the metal housing, or with a part of the metal housing provided as the contacting means and having a free end facing a front portion of the metal housing, wherein the metal housing is designed in the form of two assembled half-shells, such that at least one spring tab is provided for each half-shell and forms a single piece with said half-shell.

8. A connecting element according to claim 7, wherein the connecting element exhibits a plurality of connector jacks, and at least one spring tab designed to form a single piece with the metal housing is assigned to each connector jack in order to provide a contact with the plug housing.

9. A connecting element according claim 7, wherein at least two spring tabs, ideally positioned opposite each other, are assigned to each connector jack.

10. A connecting element according to claim 7, wherein the metal housing consists of a zinc die-casting.

11. A connecting element according to claim 7, wherein the metal housing is provided, at least in part, with an electrically conductive coating so that the spring tabs can serve as contacts, wherein nickel and/or tin are provided for the coating.

12. A connecting element for shielded data and/or telecommunications cables, with a metal housing and with at least one connector jack, comprising:

contact means provided at a front portion of the metal housing for contacting the metal housing with a plug housing, particularly with the plug housing of an RJ-45 plug;

the metal housing consists of a metal die-casting the contact means formed as part of the metal die casting;

at least one spring tab formed as a part of the contact means and forming a single piece with the metal housing, or with a part of the metal housing provided as the contacting means;

the spring tab having a free end facing a front portion of the metal housing; and a locking mechanism, separate from the spring tab, the locking mechanism providing a mechanical interlock with a mating component, wherein the metal housing is designed in the form of two assembled half-shells, such that at least one spring tab is provided for each half-shell and forms a single piece with said half-shell.

13. A connecting element according to claim 12, wherein the connecting element exhibits a plurality of connector jacks, and at least one spring tab designed to form a single piece with the metal housing is assigned to each connector jack in order to provide a contact with the plug housing.

14. A connecting element according claim 12, wherein at least two spring tabs, ideally positioned opposite each other, are assigned to each connector jack.

15. A connecting element according to claim 12, wherein the metal housing consists of a zinc die-casting.

16. A connecting element according to claim 12, wherein the metal housing is provided, at least in part, with an electrically conductive coating so that the spring tabs can serve as contacts.

17. A connecting element according to claim 16, wherein nickel and/or tin are provided for the coating.

* * * * *